United States Patent [19]

Kayahara

[11] Patent Number: 5,044,445

[45] Date of Patent: Sep. 3, 1991

[54] FIRE HOSE CAPABLE OF TRANSMITTING SIGNALS

[75] Inventor: Isao Kayahara, Tokyo, Japan

[73] Assignee: Funayama Co., Ltd., Japan

[21] Appl. No.: 534,269

[22] Filed: Jun. 7, 1990

[30] Foreign Application Priority Data

Dec. 14, 1987 [JP] Japan ..... 62-189693

[51] Int. Cl.[5] ..... A62C 33/00

[52] U.S. Cl. ..... 169/52; 169/24; 169/91; 138/108; 174/47; 439/191

[58] Field of Search ..... 169/24, 52, 91; 239/289; 138/103, 108; 174/47; 439/191, 192, 194, 195

[56] References Cited

U.S. PATENT DOCUMENTS 211,833 2/1879 Buchtel ..... 439/194
2,014,288 10/1935 Noschang ..... 439/191
3,818,116 6/1974 Kuljian ..... 174/47
4,745,238 5/1988 Kotthaus et al. ..... 174/47

FOREIGN PATENT DOCUMENTS 0337184 10/1989 Japan ..... 169/24

*Primary Examiner*—Joseph F. Peters, Jr.
*Assistant Examiner*—Linda L. Palomar
*Attorney, Agent, or Firm*—Oliff & Berridge

[57] ABSTRACT

A fire hose containing an electrical wire therein for transmitting signals. Terminals for connecting cable ways are mounted at both ends of the wire. Therefore, when one hose containing the wire is connected to another similar hose, terminals are also connected to terminals in another hose so as to make a single cable way. The use of such a hose enables a fireman holding a nozzle of the hose to control a pump located apart from the nozzle.

2 Claims, 1 Drawing Sheet

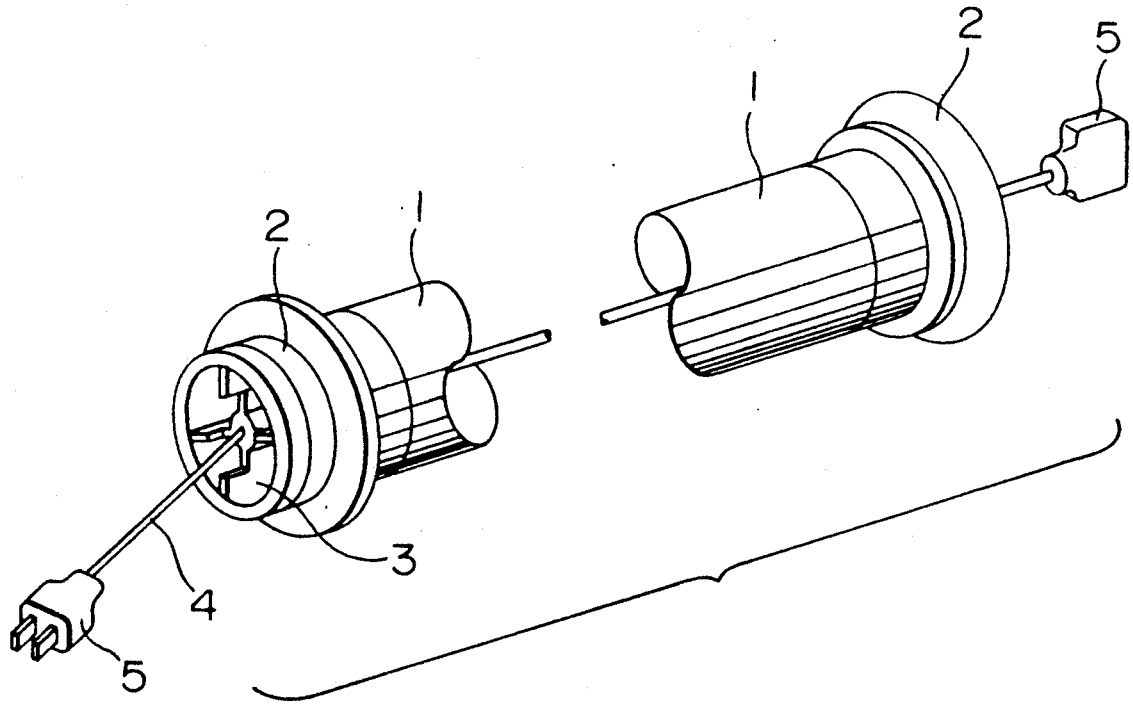
2
5
1
2
1
3
4
5

FIRE HOSE CAPABLE OF TRANSMITTING SIGNALS

BACKGROUND OF THE INVENTION

The present invention relates to a fire hose which has a cable way for signal transmission axially extending in an internal space of the hose.

Conventionally, fire fighting is executed through cooperation between a pump handler and a fireman who holds a nozzle of a fire hose, since a pump is positioned apart from the actual fire. It is obvious that if the fireman with the nozzle can directly control the pump, it is extremely advantageous for operation flexibility or labor saving. However, for that purpose, an electric circuit for controlling the pump from the nozzle is required, and, as for the control method, radio operations at the location of a fire have various difficulties. Furthermore, there are many problems in mounting a control circuit separate from the hose or attaching a wire along the hose. Therefore, such a device has not been realized yet in spite of a great demand from those who are actually concerned with fighting fires.

SUMMARY OF THE INVENTION

An object of the present invention is to solve the above problems and to safely and properly lay a control cable way between a nozzle portion and a pump position by making a hose and a cable way as a unit.

According to the present invention, a wire, which is provided with terminals for electric connection at both ends thereof, extends inside of a fire hose of a unit length. When the hose is connected to another hose, the wire is combined with a corresponding connecting terminal in the end of another hose so as to make a united circuit. Inside of connecting metal fittings at both ends of a hose of an arbitrary length, which is constructed by connecting hoses of a unit length, terminals for connecting cable ways are always exposed. Thus, a hose capable of transmitting signals can be obtained.

BRIEF DESCRIPTION OF THE DRAWING

The single figure is a perspective view of a long fire hose, whose middle portion is cut off, of the present invention.

DESCRIPTION OF THE PREFERRED EMBODIMENT

Referring to the figure, which is a perspective view of a fire hose of a unit length whose middle portion is cut off, 1 denotes a hose and 2 denotes a metal hose fitting. The metal hose fitting 2 houses a wire supporting metal mounting 3 therein. The wire supporting metal mounting 3 comprises a space for containing a terminal for connecting cable ways at the end portion of the metal hose fitting 2, a retaining plane for retaining the back face of the connecting terminal against the inward tension of a wire, and a penetrating hole for loosely supporting the wire.

4 denotes a wire and 5 denotes a terminal for connecting the cable ways 4, 5. The wire 4 is constructed to be extendable, that is, when the hose is used, the wire is extended according to the extension of the hose and contracted according to the recovery and contraction of the hose. The terminal 5 is completely waterproof in its electric connection portion and resistant against water pressure when the terminal 5 is connected to another terminal.

By using such a hose, which has the wire axially extending in the internal space of the hose, it is easy to take a conductive wire out of the nozzle and the pump and to complete a cable way for engine control. Therefore, remote control of the fire pump and directions to a man or a robot positioned at the end of the hose is facilitated and made possible. As a result, the present invention makes a great contribution to the task of fighting fires and labor saving.

What is claimed is:

1. A hose comprising:

an elongate, hollow hose section;

a metal connecting fitting at each end of the hose section for connecting the hose to another hose or fitting;

a wire supporting member mounted inside each connecting fitting;

an electrical wire disposed within the hose section, each end of the electrical wire penetrating an associated one of the wire supporting members, the portion of the electrical wire extending between the supporting members being freely displaceable relative to the hose section; and connector means on the ends of the electrical wire penetrating the wire supporting members, for connecting cableways at each end of the hose.

2. A hose as in claim 1, wherein the wire supporting members support the ends of the electrical wire substantially centrally within each connecting fitting.

* * * * *